US011564425B2

(12) United States Patent
Ito

(10) Patent No.: US 11,564,425 B2
(45) Date of Patent: Jan. 31, 2023

(54) MASK

(71) Applicant: MUYU CO., LTD., Tokyo (JP)

(72) Inventor: Hiroshi Ito, Toyko (JP)

(73) Assignee: MUYU CO., LTD., Tokyo (JP)

( * ) Notice: Subject to any disclaimer, the term of this patent is extended or adjusted under 35 U.S.C. 154(b) by 201 days.

(21) Appl. No.: 17/025,357

(22) Filed: Sep. 18, 2020

(65) Prior Publication Data

US 2021/0000202 A1 Jan. 7, 2021

(30) Foreign Application Priority Data

Jun. 15, 2020 (JP) ..... JP2020-102984

(51) Int. Cl.
*A41D 13/11* (2006.01)
*A41D 27/00* (2006.01)

(52) U.S. Cl.
CPC ..... *A41D 13/1161* (2013.01)

(58) Field of Classification Search
CPC .... A41D 13/11–1192; A62B 23/00–04; A62B 18/00; A62B 18/02; A62B 18/08; A62B 18/084
See application file for complete search history.

(56) References Cited

U.S. PATENT DOCUMENTS 3,884,227 A * 5/1975 Lutz ..... A41D 13/1115 128/206.19
2003/0154984 A1* 8/2003 Fernandes ..... A62B 18/084 128/206.13
2004/0016037 A1* 1/2004 Griesbach, III ... A41D 13/1161 2/12
2015/0335080 A1* 11/2015 Giles ..... A41D 13/1115 29/451

FOREIGN PATENT DOCUMENTS

| | | | |
|---|---|---|---|
| JP | S55-27510 | U | 2/1980 |
| JP | H10-286319 | A | 10/1998 |
| JP | 2001-178837 | A | 7/2001 |
| JP | 2004-89645 | A | 3/2004 |
| JP | 3117487 | U | 1/2006 |

(Continued)

OTHER PUBLICATIONS

Sep. 29, 2020 Office Action issued in Japanese Patent Application No. 2020-102984.

(Continued)

*Primary Examiner* — Michelle J Lee
(74) *Attorney, Agent, or Firm* — Oliff PLC

(57) ABSTRACT

A mask includes a main body part, a pair of ear straps, and a support part. The main body part covers a wearer's mouth and has an upper end fixing point where an upper end part of each of the ear straps is fixed, and a lower end fixing point where a lower end part of each of the ear straps is fixed. The pair of ear straps are provided on both the left and right sides of the main body part, and are hooked on the wearer's ears. The support part is provided in the main body part, and supports one location of an intermediate part of each of the ear straps. The support part is located in a top region between the upper end fixing point and an upper end of the main body part, with respect to the vertical direction of the main body part.

20 Claims, 13 Drawing Sheets

(56) References Cited

FOREIGN PATENT DOCUMENTS

| | | | | |
|---|---|---|---|---|
| JP | 2007-20794 | A | | 2/2007 |
| JP | 2012-40163 | A | | 3/2012 |
| JP | 2013-220301 | A | | 10/2013 |
| JP | 2017-519914 | A | | 7/2017 |
| KR | 20-2011-0005054 | U | | 5/2011 |
| KR | 200484799 | Y1 | * | 10/2017 |
| KR | 10-2008346 | B1 | | 8/2019 |
| KR | 20200000195 | A | * | 1/2020 |
| KR | 20200000720 | U | * | 4/2020 |
| WO | WO-2019231033 | A1 | * | 12/2019 |

OTHER PUBLICATIONS

Feb. 9, 2021 Office Action issued in Japanese Patent Application No. 2020-102984.
Jun. 8, 2021 Office Action issued in Japanese Patent Application No. 2021-38926.
Oct. 5, 2021 Office Action issued in Japanese Patent Application No. 2021-38926.

* cited by examiner

MASK

CROSS REFERENCE TO RELATED APPLICATION

This application is based on Japanese patent application No. 2020-102984 filed Jun. 15, 2020, the content of which is hereby incorporated by reference.

BACKGROUND OF THE INVENTION

1. Field of the Invention

The present invention relates to a mask that covers a person's nose, mouth, and the like.

2. Description of the Related Art

The mask disclosed in JP 2012-40163A can be given as an example of a conventional mask. The mask described in this document includes a main body part that covers a wearer's nose and mouth and ear straps for securing the main body part to the wearer's face. The main body part is formed from a breathable sheet-form material. The ear straps are attached to both the left and right sides of the main body part.

The stated mask has a function of preventing harmful particles (viruses, bacteria, pollen, and the like) from entering the nasal cavity and oral cavity by covering the nose and mouth with the main body part. However, there is a problem in that if there is a gap between the face and both side ends of the main body part, harmful particles can enter into the space within the main body part (the space between the main body part and the face) through the stated gap.

SUMMARY OF THE INVENTION

Having been made in view of the above-described problem, an object of the present invention is to provide a mask which makes it difficult for a gap to arise between a face and both side ends of a main body part.

A mask according to the present invention includes: a main body part that covers a mouth of a wearer; a pair of ear straps provided on left and right sides of the main body part and hooked over ears of the wearer; and a first support part that is provided in the main body part and that supports one location of an intermediate part of each of the ear straps, wherein the main body part has an upper end fixing point which is a part where an upper end part of each of the ear straps is fixed, and a lower end fixing point which is a part where a lower end part of each of the ear straps is fixed; and the first support part is located in a top region which is a region between the upper end fixing point and an upper end of the main body part with respect to a vertical direction of the main body part, or is located in a bottom region which is a region between the lower end fixing point and a lower end of the main body part with respect to the vertical direction.

In this mask, the first support part which supports the one location of the intermediate part of the ear strap is provided in the top region or the bottom region of the main body part. When the first support part is located in the top region, an upward force from the ear strap can be caused to act on the upper end fixing point of the main body part by having the ear strap extend from the upper end fixing point to the wearer's ear via the first support part. On the other hand, when the first support part is located in the bottom region, a downward force from the ear strap can be caused to act on the lower end fixing point of the main body part by having the ear strap extend from the lower end fixing point to the wearer's ear via the first support part. Causing the force to act on the upper end fixing point or the lower end fixing point outward in the vertical direction (away from each other) in this manner makes it possible to ensure both side ends of the main body part are less likely to slacken.

According to the present invention, a mask which makes it difficult for a gap to arise between a face and both side ends of a main body part is realized.

DETAILED DESCRIPTION OF THE INVENTION

Figure 1:
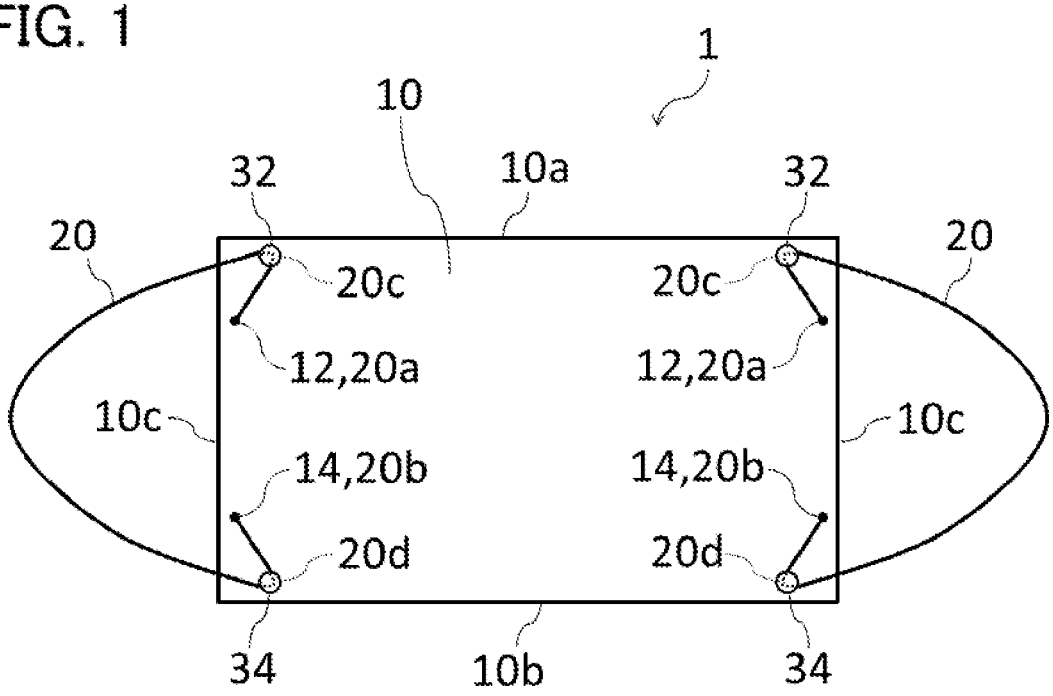
FIG. 1 is a front view illustrating an embodiment of a mask according to the present invention.

An embodiment of the present invention will be described in detail hereinafter with reference to the drawings. In the drawings, identical elements are given identical reference signs, and descriptions thereof will not be repeated.

FIG. 1 is a front view illustrating an embodiment of a mask according to the present invention. A mask 1 includes a main body part 10, a pair of ear straps 20, support parts 32 (first support parts), and support parts 34 (second support parts). The main body part 10 covers a wearer's mouth. Of the eyes, nose, and mouth, the main body part 10 may cover only the nose and mouth, or only the mouth. When the mask 1 is not being worn, the main body part 10 is in the form of a flat, rectangular sheet. This drawing illustrates the outer surface of the main body part 10, namely the surface opposite from the inner surface, the inner surface being the surface facing the wearer's face. The main body part 10 is made of a breathable material. For example, a nonwoven fabric, paper, or gauze can be used as the material.

The main body part 10 has upper end fixing points 12 and lower end fixing points 14. The upper end fixing point 12 is a part of the main body part 10, to which an upper end part 20*a* of each of the ear straps 20 is fixed. The upper end parts 20*a* are fixed to the outer surface of the main body part 10. As such, the upper end fixing points 12 exist on the outer surface of the main body part 10. The ear straps 20 (upper end parts 20*a*) can be fixed to the upper end fixing points 12 by, for example, welding (ultrasonic welding, heat welding, or the like).

The lower end fixing point 14 is a part of the main body part 10, to which a lower end part 20*b* of each of the ear straps 20 is fixed. The lower end parts 20*b* are fixed to the outer surface of the main body part 10. As such, the lower end fixing points 14 exist on the outer surface of the main body part 10. The ear straps 20 (lower end parts 20*b*) can be fixed to the lower end fixing points 14 by, for example, welding.

The ear straps 20 are provided on both the left and right sides of the main body part 10. When the mask 1 is worn, the ear straps 20 are hooked over the wearer's ears. This fixes the main body part 10 to the wearer's face. The ear straps 20 exhibit elasticity. For example, rubber cords can be used as the ear straps 20.

The support parts 32 are provided in the main body part 10, and support one location 20*c* of an intermediate part of each of the ear straps 20. The intermediate part of the ear strap 20 is a part of the ear strap 20 excluding the upper end part 20*a* and the lower end part 20*b*. The support parts 32 support the locations 20*c* of the ear straps 20 from the outside so that the ear straps 20 extend from the upper end fixing points 12 to the wearer's ears via the support parts 32. However, the support parts 32 do not immobilize the ear straps 20. In other words, the ear straps 20 can displace relative to the support parts 32 while being supported by the support parts 32. As such, pulling the ear straps 20 causes the locations 20*c* where the ear straps 20 are supported by the support parts 32 (that is, the locations of the ear straps 20 that make contact with the support parts 32) to vary. The support parts 32 support the locations 20*c* of the ear straps 20 on the outer surface side of the main body part 10.

Figure 2:
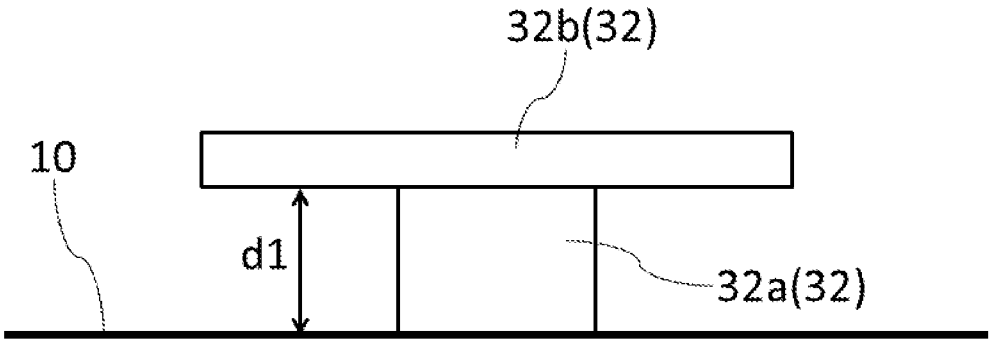
FIG. 2 is a side view illustrating a support part 32.
Figure 3:
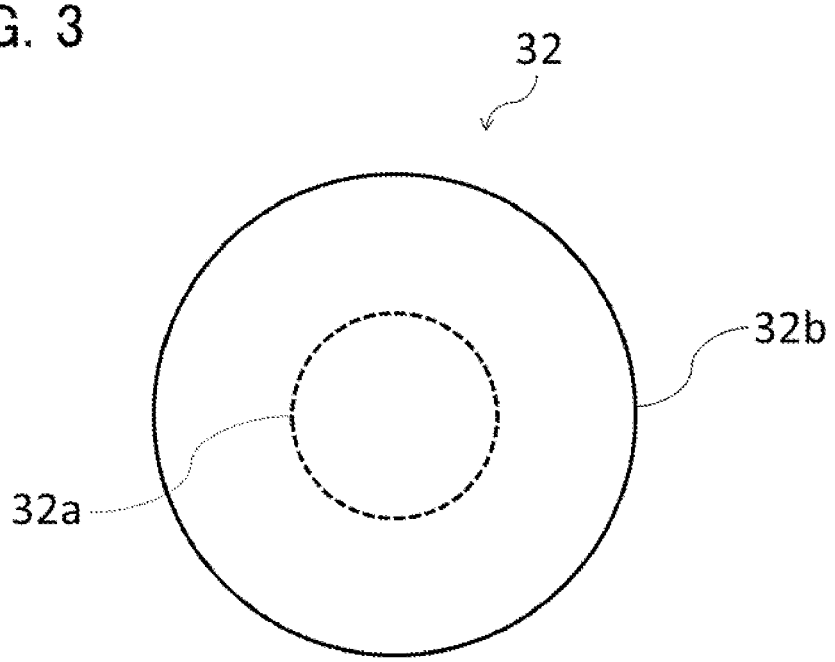
FIG. 3 is a front view illustrating the support part 32.

FIG. 2 and FIG. 3 are, respectively, a side view and a front view of the support part 32. FIG. 2 illustrates the support part 32 from the horizontal direction of the main body part 10 (corresponding to the horizontal direction in FIG. 1). FIG. 3 illustrates the support part 32 from the same perspective as in FIG. 1, namely from the outer surface side of the main body part 10. The support part 32 has a screw-like shape, and has a support shaft 32*a* and a top plate 32*b*. The support shaft 32*a* is cylindrical or rod-shaped, and extends from the outer surface of the main body part 10 to the top plate 32*b*. When the mask 1 is worn, the ear strap 20 is hooked onto the support shaft 32*a*. The ear strap 20 is supported by the support part 32 as a result. The top plate 32*b* is disk-shaped, and protrudes from the support shaft 32*a* as seen from the front (see FIG. 1). To be more specific, a center axis of the top plate 32*b* is located on a line extending from a center axis of the support shaft 32*a*, and the diameter of the top plate 32*b* is greater than the diameter of the support shaft 32*a*. The top plate 32*b* functions as a stopper for ensuring that the ear strap 20 does not come off the support shaft 32*a* when the mask 1 is worn.

An interval d1 between the top plate 32*b* and the main body part 10 (see FIG. 2) is made greater than the thickness of the ear strap 20 so that the ear strap 20 can displace freely while remaining hooked onto the support shaft 32*a*. The support part 32 is fixed to the main body part 10. The support part 32 can be fixed to the main body part 10 through, for example, adhesion (hot-melt adhesion or the like). Alternatively, the support part 32 may be fixed to the main body part 10 by having the support shaft 32*a* penetrate through the main body part 10 and fitting a receiving member to the support shaft 32*a* from the opposite side (i.e., the inner surface side of the main body part 10). Metal, resin, paper, and so on can be given as examples of the material of the support part 32.

Figure 4:
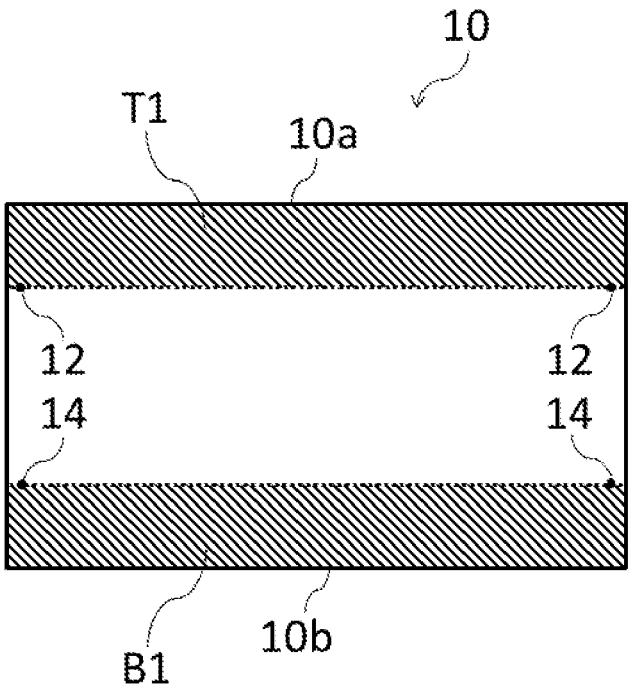
FIG. 4 is a diagram illustrating a top region T1 and a bottom region B1 of a main body part 10.
Figure 5:
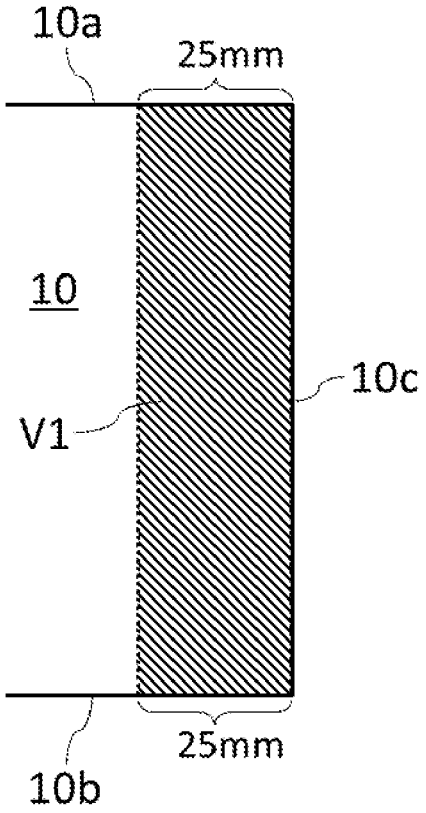
FIG. 5 is a diagram illustrating a vicinity V1 of a side end 10*c* of the main body part 10.

The support parts 32 are located in a top region T1 of the main body part 10 (see FIG. 4). The top region T1 is a region located between the upper end fixing points 12 and an upper end 10*a* of the main body part 10 with respect to the vertical direction of the main body part 10 (corresponding to the vertical direction in FIG. 1). In other words, a distance from the support parts 32 to the upper end 10*a* is smaller than a distance from the upper end fixing points 12 to the upper end 10*a*. Each of the support parts 32 is preferably located in a vicinity V1 of a side end 10*c* of the main body part 10 (see FIG. 5). The vicinity V1 is a region within 25 mm of the side end 10*c* of the main body part 10.

Figure 6:
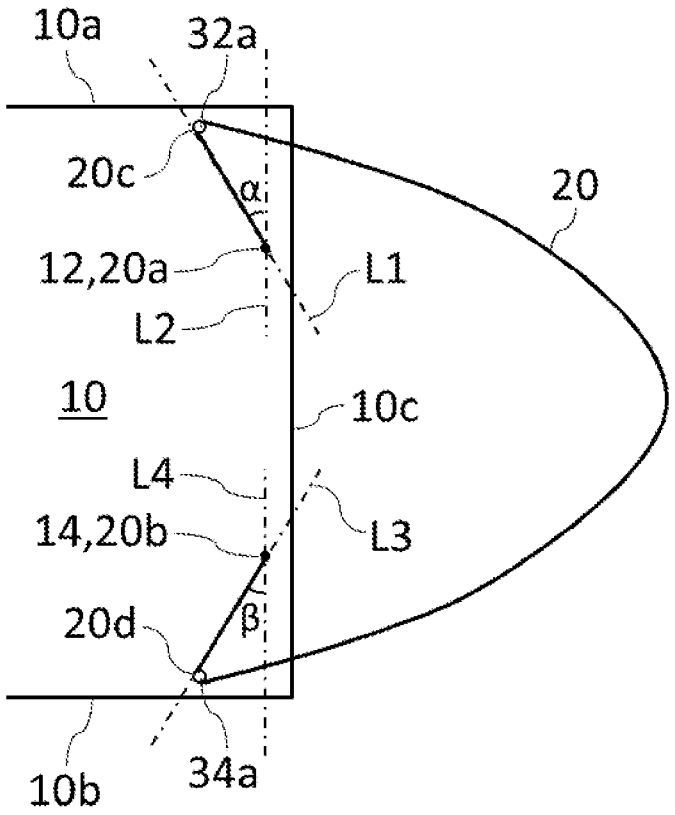
FIG. 6 is a diagram illustrating a positional relationship between an upper end fixing point 12 and the support part 32, and a positional relationship between a lower end fixing point 14 and a support part 34.

In terms of the horizontal direction of the main body part 10, the support parts 32 are located inside the upper end fixing points 12. In other words, a distance from the support part 32 to the side end 10*c* (the side end 10*c* closer to that support part 32) is greater than a distance from the upper end fixing point 12 to the side end 10*c* (the side end 10*c* closer to that upper end fixing point 12). As illustrated in FIG. 6, when, in a front view, an angle formed by a straight line L1 passing through the upper end part 20*a* (upper end fixing point 12) and the location 20*c* of the ear strap 20 and a straight line L2 passing through the upper end part 20*a* and extending in the vertical direction of the main body part 10 is represented by $\alpha$, that angle is preferably $15° \leq \alpha \leq 45°$. When the part of the ear strap 20 from the upper end part 20*a* to the location 20*c* is extended in a straight line without slack, that part overlaps with the straight line L1. Note that the top plate 32*b* is not shown in FIG. 6 to better illustrate the configuration.

The support parts 34 are provided in the main body part 10, and support another location 20*d* of the intermediate part of each of the ear straps 20. The support parts 34 support the locations 20*d* of the ear straps 20 from the outside so that the ear straps 20 extend from the lower end fixing points 14 to the wearer's ears via the support parts 34. However, the support parts 34 do not immobilize the ear straps 20. In other words, the ear straps 20 can displace relative to the support parts 34 while being supported by the support parts 34. As such, pulling the ear straps 20 causes the locations 20*d* where the ear straps 20 are supported by the support parts 34 (that is, the locations of the ear straps 20 that make contact with the support parts 34) to vary. The support parts 34 support the locations 20*d* of the ear straps 20 on the outer surface side of the main body part 10.

Figure 7:
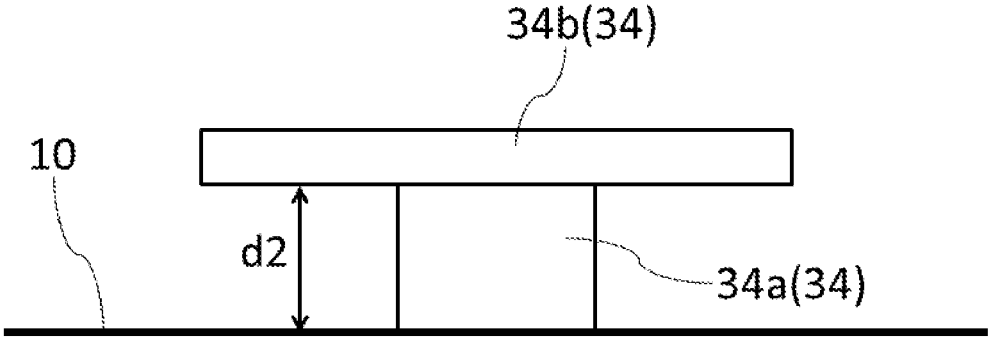
FIG. 7 is a side view illustrating the support part 34.
Figure 8:
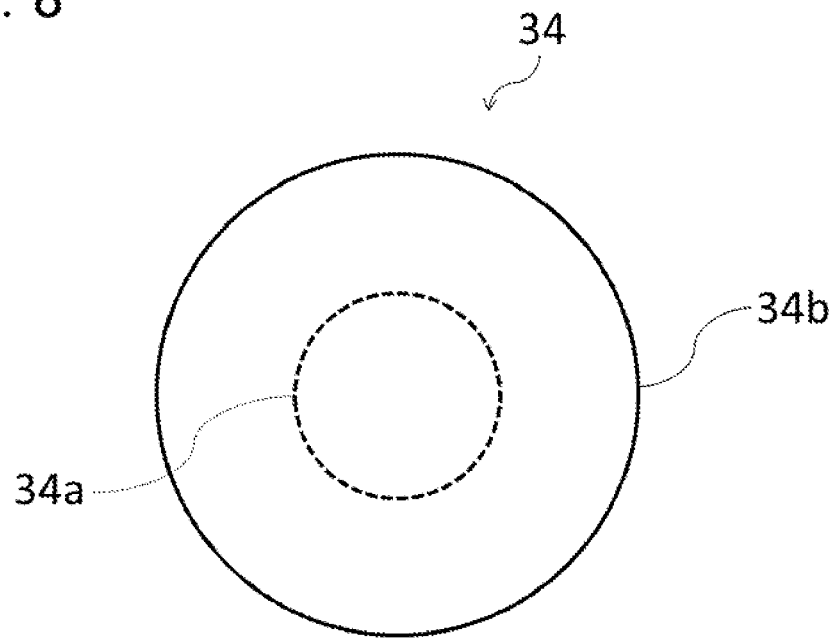
FIG. 8 is a front view illustrating the support part 34.

FIG. 7 and FIG. 8 are, respectively, a side view and a front view of the support part 34. FIG. 7 illustrates the support part 34 from the horizontal direction of the main body part 10. FIG. 8 illustrates the support part 34 from the same perspective as in FIG. 1, namely from the outer surface side of the main body part 10. The support part 34 has a screw-like shape, and has a support shaft 34*a* and a top plate 34*b*. The support shaft 34*a* is cylindrical or rod-shaped, and extends from the outer surface of the main body part 10 to the top plate 34*b*. When the mask 1 is worn, the ear strap 20 is hooked onto the support shaft 34*a*. The ear strap 20 is supported by the support part 34 as a result. The top plate 34*b* is disk-shaped, and protrudes from the support shaft 34*a* as seen from the front. To be more specific, a center axis of the top plate 34*b* is located on a line extending from a center axis of the support shaft 34*a*, and the diameter of the top plate 34*b* is greater than the diameter of the support shaft

34*a*. The top plate 34*b* functions as a stopper for ensuring that the ear strap 20 does not come off the support shaft 34*a* when the mask 1 is worn.

An interval d2 between the top plate 34*b* and the main body part 10 (see FIG. 7) is made greater than the thickness of the ear strap 20 so that the ear strap 20 can displace freely while remaining hooked onto the support shaft 34*a*. The support part 34 is fixed to the main body part 10. The support part 34 can be fixed to the main body part 10 through adhesion, for example. Alternatively, the support part 34 may be fixed to the main body part 10 by having the support shaft 34*a* penetrate through the main body part 10 and fitting a receiving member to the support shaft 34*a* from the opposite side. Metal, resin, paper, and so on can be given as examples of the material of the support part 34.

The support parts 34 are located in a bottom region B1 of the main body part 10 (see FIG. 4). The bottom region B1 is a region located between the lower end fixing points 14 and a lower end 10*b* of the main body part 10 with respect to the vertical direction of the main body part 10. In other words, a distance from the support parts 34 to the lower end 10*b* is smaller than a distance from the lower end fixing points 14 to the lower end 10*b*. Each of the support parts 34 is preferably located in the vicinity V1 of the side end 10*c* of the main body part 10 (see FIG. 5).

In terms of the horizontal direction of the main body part 10, the support parts 34 are located inside the lower end fixing points 14. In other words, a distance from the support part 34 to the side end 10*c* (the side end 10*c* closer to that support part 34) is greater than a distance from the lower end fixing point 14 to the side end 10*c* (the side end 10*c* closer to that lower end fixing point 14). As illustrated in FIG. 6, when, in a front view, an angle formed by a straight line L3 passing through the lower end part 20*b* (lower end fixing point 14) and the location 20*d* of the ear strap 20 and a straight line L4 passing through the lower end part 20*b* and extending in the vertical direction of the main body part 10 is represented by β, that angle is preferably $15° \leq \beta \leq 45°$. When the part of the ear strap 20 from the lower end part 20*b* to the location 20*d* is extended in a straight line without slack, that part overlaps with the straight line L3. Note that the top plate 34*b* is not shown in FIG. 6 to better illustrate the configuration.

Figure 9:
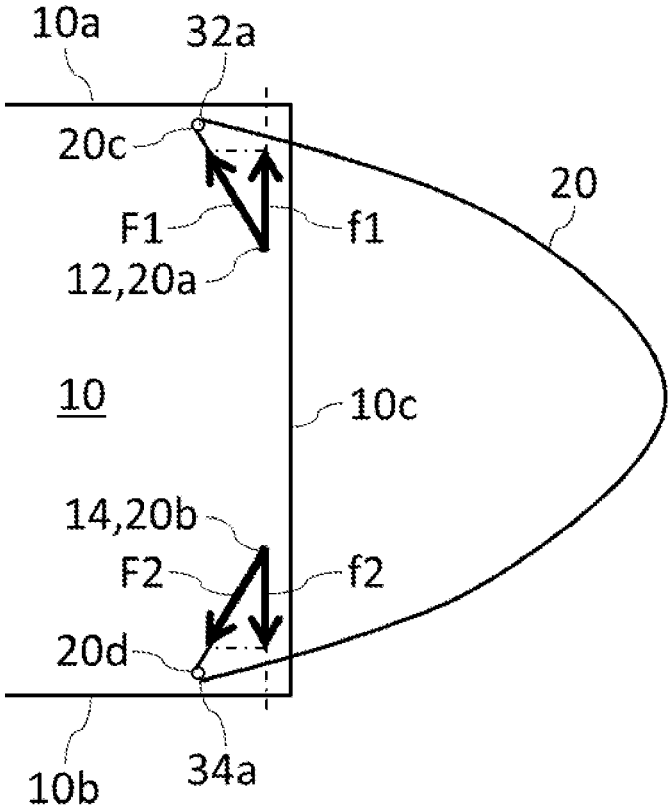
FIG. 9 is a diagram illustrating an effect of the mask of FIG. 1.

Effects of the mask 1 will be described. In the mask 1, the support parts 32, which support the locations 20*c* in the intermediate parts of the ear straps 20, are provided in the top region T1 of the main body part 10. By extending the ear straps 20 from the upper end fixing points 12 to the wearer's ears via the support parts 32, an upward force f1 acts on the upper end fixing points 12 of the main body part 10 from the ear straps 20, as illustrated in FIG. 9. The force f1 is a vertical component force when a force F1 acting on the upper end fixing points 12 from the ear straps 20 is broken down into the vertical direction and the horizontal direction of the main body part 10. Note that the top plates 32*b* and 34*b* are not shown in FIG. 9 to better illustrate the configuration. Causing the force f1, which acts outward in the vertical direction (away from the lower end fixing points 14), to act on the upper end fixing points 12 in this manner makes it possible to ensure both side ends 10*c* of the main body part 10 are less likely to slacken. The mask 1 which makes it difficult for a gap to arise between the face and both side ends 10*c* of the main body part 10 is realized as a result.

Furthermore, the support parts 34, which support the other locations 20*d* in the intermediate parts of the ear straps 20, are provided in the bottom region B1 of the main body part 10. By extending the ear straps 20 from the lower end fixing points 14 to the wearer's ears via the support parts 34, a downward force f2 acts on the lower end fixing points 14 of the main body part 10 from the ear straps 20, as illustrated in FIG. 9. The force f2 is a vertical component force when a force F2 acting on the lower end fixing points 14 from the ear straps 20 is broken down into the vertical direction and the horizontal direction of the main body part 10. Causing the force f2, which acts outward in the vertical direction (away from the upper end fixing points 12), to act on the lower end fixing points 14 as well in this manner makes it possible to ensure both side ends 10*c* of the main body part 10 are even less likely to slacken.

Thus in the mask 1, providing the support parts 32 and 34 and transforming the direction of the forces acting on the upper end fixing points 12 and the lower end fixing points 14 from the ear straps 20 makes it less likely that both side ends 10*c* of the main body part 10 will slacken, and improves the tightness of the fit of both side ends 10*c* to the face.

When the support parts 32 and 34 are located in the vicinity of the side ends 10*c* of the main body part 10, a situation where the distances from the support parts 32 and 34 to the wearer's ears are needlessly increased can be avoided. As these distances increase, it becomes necessary to increase the overall lengths of the ear straps 20 by that amount, which is disadvantageous in terms of the cost of manufacturing the mask 1.

The support parts 32 support the locations 20*c* of the ear straps 20 on the outer surface side of the main body part 10. This is advantageous in that the support parts 32 do not make contact with the face when the mask 1 is worn. Likewise, the support parts 34 support the locations 20*d* of the ear straps 20 on the outer surface side of the main body part 10. This is advantageous in that the support parts 34 do not make contact with the face when the mask 1 is worn. Furthermore, when the support parts 32 and 34 are on the outer surface side of the main body part 10 in this manner, the side ends 10*c* of the main body part 10 are held down from the outer surface side by the ear straps 20. This also works to the advantage of improving the tightness of the fit of both side ends 10*c* to the face.

In terms of the horizontal direction of the main body part 10, the support parts 32 are located inside the upper end fixing points 12. In this case, the force acting outward in the horizontal direction (the direction in which the pair of support parts 32 face away from each other), which the support parts 32 receive from the ear straps 20, can be increased. This also works to the advantage of improving the tightness of the fit of the upper end 10*a* of the main body part 10 to the face.

Figure 10:
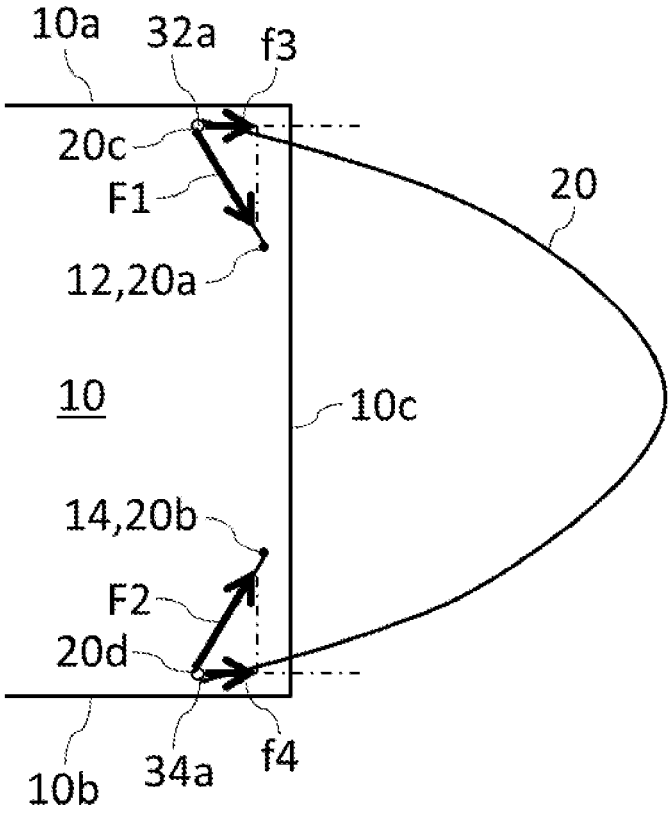
FIG. 10 is a diagram illustrating an effect of the mask of FIG. 1.

To elaborate, as illustrated in FIG. 10, the reaction to the force F1 with which the ear straps 20 pull the upper end fixing points 12 (see FIG. 9) causes the support parts 32 to also be pulled by the force F1 from the ear straps 20 (the parts from the upper end parts 20*a* to the locations 20*c*). At this time, because the support parts 32 are located inside the upper end fixing points 12, a horizontal component force f3 obtained when the force F1 is broken down into the vertical direction and the horizontal direction of the main body part 10, becomes an outward force in the horizontal direction, and contributes to the pulling of the support parts 32 outward in the horizontal direction. In contrast, if the support parts 32 are located outside the upper end fixing points 12 with respect to the horizontal direction of the main body part 10, the value of the component force f3 (where the outward direction is positive) becomes negative, and thus the component force f3 does not contribute to the pulling of the support parts 32 outward in the horizontal direction. Thus by providing the support parts 32 inside the upper end fixing points 12, the force from the ear straps 20 acting outward in the horizontal direction, which is received by the support parts 32, can be amplified. Note that the top plates 32*b* and 34*b* are not shown in FIG. 10 to better illustrate the configuration.

As the angle α formed by the straight line L1 and the straight line L2 (see FIG. 6) increases, the outward force f3 in the horizontal direction, which acts on the support parts 32, increases as well, while the outward force f1 in the vertical direction, which acts on the upper end fixing points 12 (see FIG. 9), decreases. Thus in light of the equilibrium between the magnitude of the force f1 and the magnitude of the force f3, it is preferable that $15° \leq \alpha \leq 45°$.

In terms of the horizontal direction of the main body part 10, the support parts 34 are located inside the lower end fixing points 14. In this case, the force acting outward in the horizontal direction (the direction in which the pair of support parts 34 face away from each other), which the support parts 34 receive from the ear straps 20, can be increased. This also works to the advantage of improving the tightness of the fit of the lower end 10*b* of the main body part 10 to the face.

To elaborate, as illustrated in FIG. 10, the reaction to the force F2 with which the ear straps 20 pull the lower end fixing points 14 (see FIG. 9) causes the support parts 34 to also be pulled by the force F2 from the ear straps 20 (the parts from the lower end parts 20*b* to the locations 20*d*). At this time, because the support parts 34 are located inside the lower end fixing points 14, a horizontal component force f4 obtained when the force F2 is broken down into the vertical direction and the horizontal direction of the main body part 10, becomes an outward force in the horizontal direction, and contributes to the pulling of the support parts 34 outward in the horizontal direction. In contrast, if the support parts 34 are located outside the lower end fixing points 14 with respect to the horizontal direction of the main body part 10, the value of the component force f4 (where the outward direction is positive) becomes negative, and thus the component force f4 does not contribute to the pulling of the support parts 34 outward in the horizontal direction. Thus by providing the support parts 34 inside the lower end fixing points 14, the force from the ear straps 20 acting outward in the horizontal direction, which is received by the support parts 34, can be amplified.

As the angle β formed by the straight line L3 and the straight line L4 (see FIG. 6) increases, the outward force f4 in the horizontal direction, which acts on the support parts 34, increases as well, while the outward force f2 in the vertical direction, which acts on the lower end fixing points 14 (see FIG. 9), decreases. Thus in light of the equilibrium between the magnitude of the force f2 and the magnitude of the force f4, it is preferable that $15° \leq \beta \leq 45°$.

The ear straps 20 exhibit elasticity. In this case, the forces (F1 and F2) acting on the upper end fixing points 12 and the lower end fixing points 14 from the ear straps 20 are increased by the tension (contractive force) of the ear straps 20. Accordingly, the outward forces f1 and f2 in the vertical direction and the outward forces f3 and f4 in the horizontal direction can be increased.

The present invention is not limited to the foregoing embodiment, and many variations can be made thereon. In the foregoing embodiment, the main body part 10 may have a bag-shaped or pocket-shaped moisture-retaining material holding part in which a moisture-retaining material is held. In this case, using the mask in a state where a moisture-retaining material is held in the moisture-retaining material holding part makes it possible to increase the humidity of the space within the main body part 10. Increasing the humidity of this space can be expected to provide an effect of reducing the infectiousness of influenza viruses and the like.

The foregoing embodiment described an example in which the support parts 32 are provided inside the upper end fixing points 12 with respect to the horizontal direction of the main body part 10. However, with respect to the horizontal direction of the main body part 10, the support parts 32 may be provided in the same locations as the upper end fixing points 12, or outside the upper end fixing points 12. In the former case, the stated angle α (see FIG. 6), becomes 0, which makes it possible to maximize the force f1, which acts outward in the vertical direction on the upper end fixing points 12.

The foregoing embodiment described an example in which the support parts 34 are provided inside the lower end fixing points 14 with respect to the horizontal direction of the main body part 10. However, with respect to the horizontal direction of the main body part 10, the support parts 34 may be provided in the same locations as the lower end fixing points 14, or outside the lower end fixing points 14. In the former case, the stated angle β (see FIG. 6) becomes 0, which makes it possible to maximize the force f2, which acts outward in the vertical direction on the lower end fixing points 14.

Figure 11:
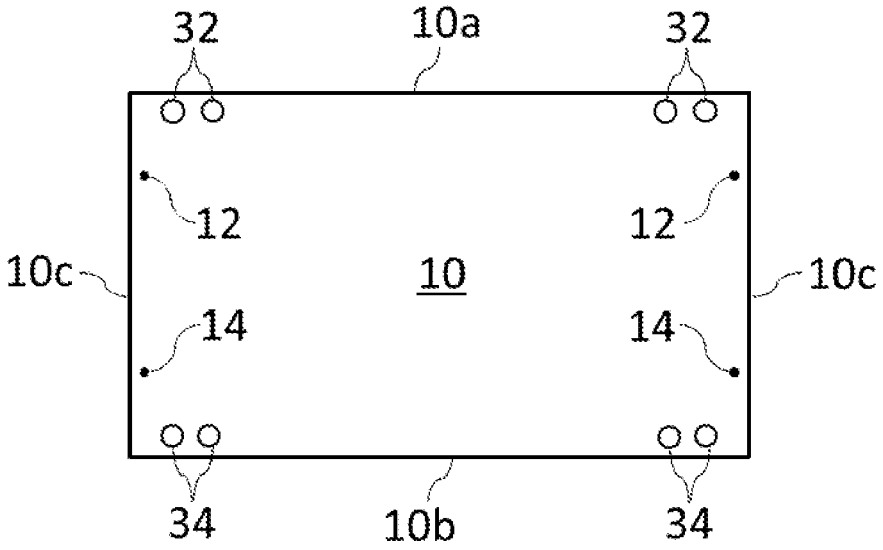
FIG. 11 is a diagram illustrating a variation on the support part 32 and the support part 34.

The foregoing embodiment described an example in which a single support part 32 is provided for each of the ear straps 20. However, a plurality of the support parts 32 may be provided for each of the ear straps 20, as illustrated in FIG. 11, for example. In this drawing, two of the support parts 32 are provided for each of the ear straps 20. These support parts 32 are provided in different locations with respect to the horizontal direction of the main body part 10. In other words, a distance from one of the support parts 32 to the side end 10*c* (the side end 10*c* closer to that support part 32) and a distance from the other of the support parts 32 to the side end 10*c* (the side end 10*c* closer to that support part 32) are different. In this case, the effective length of the ear straps 20 (the length of the part protruding from the main body part 10) can be adjusted in accordance with the size of the wearer's face. In other words, while the effective length of the ear straps 20 can be reduced by causing the ear straps 20 to be supported by the support parts 32 located relatively inside (the support parts 32 further from the side ends 10*c*), the effective length of the ear straps 20 can be increased by causing the ear straps 20 to be supported by the support parts 32 located relatively outside (the support parts 32 closer to the side ends 10*c*).

The foregoing embodiment described an example in which a single support part 34 is provided for each of the ear straps 20. However, a plurality of the support parts 34 may be provided for each of the ear straps 20, as illustrated in FIG. 11, for example. In this drawing, two of the support parts 34 are provided for each of the ear straps 20. These support parts 34 are provided in different locations with respect to the horizontal direction of the main body part 10. In other words, a distance from one of the support parts 34 to the side end 10*c* (the side end 10*c* closer to that support part 34) and a distance from the other of the support parts 34 to the side end 10*c* (the side end 10*c* closer to that support part 34) are different. In this case, the effective length of the ear straps 20 can be adjusted in accordance with the size of the wearer's face. In other words, while the effective length of the ear straps 20 can be reduced by causing the ear straps 20 to be supported by the support parts 34 located relatively inside (the support parts 34 further from the side ends 10*c*), the effective length of the ear straps 20 can be increased by causing the ear straps 20 to be supported by the support parts 34 located relatively outside (the support parts 34 closer to the side ends 10*c*).

The foregoing embodiment described an example in which the support parts 32 and the support parts 34 support the intermediate parts of the ear straps 20 on the outer surface side of the main body part 10. However, the support parts 32 and the support parts 34 may support the intermediate parts of the ear straps 20 on the inner surface side of the main body part 10. In this case, the upper end fixing points 12 and the lower end fixing points 14 exist on the inner surface of the main body part 10.

Figure 12:
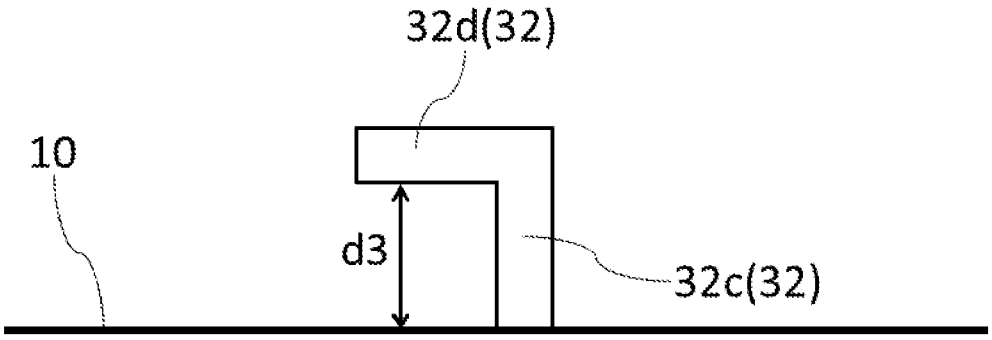
FIG. 12 is a diagram illustrating another variation on the support part 32.

The foregoing embodiment described an example in which the support part 32 is constituted by the support shaft 32*a* and the top plate 32*b*. However, the support part 32 may have a hook (clasp) shape, for example, as illustrated in FIG. 12. In this drawing, the support part 32 is bent inward with respect to the horizontal direction of the main body part 10. This hook-shaped support part 32 supports the ear strap 20 with the ear strap 20 hooked on a vertical part 32*c* of the support part 32. A horizontal part 32*d* of the support part 32 functions as a stopper for ensuring that the ear strap 20 does not come off the vertical part 32*c*. An interval d3 between the horizontal part 32*d* and the main body part 10 is made greater than the thickness of the ear strap 20 so that the ear strap 20 can displace freely while remaining hooked onto the vertical part 32*c*.

Figure 13:
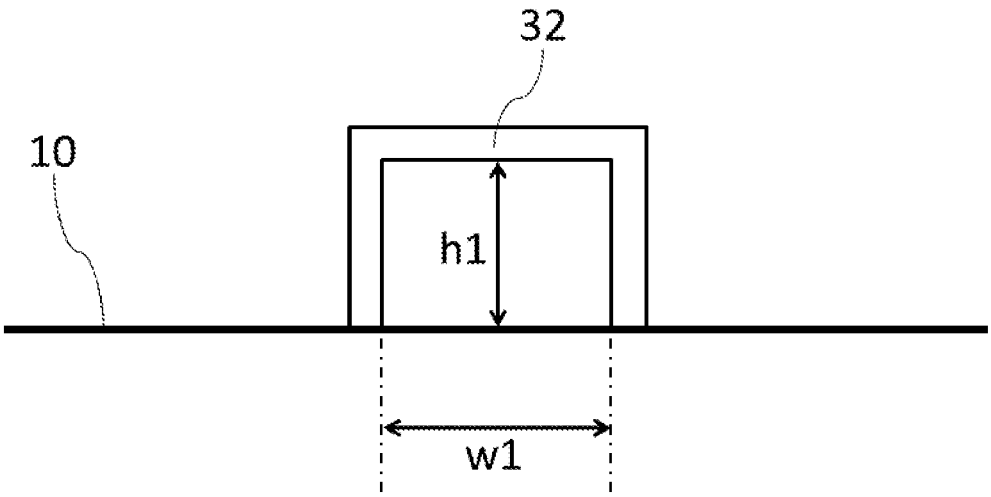
FIG. 13 is a diagram illustrating another variation on the support part 32.

The support part 32 may have a gate shape, for example, as illustrated in FIG. 13. This gate-shaped support part 32 supports the ear strap 20 with the ear strap 20 passed through the gate. A width w1 and a height h1 of the gate are made greater than the thickness of the ear strap 20 so that the ear strap 20 can displace freely while remaining within the support part 32.

Additionally, the support part 32 may be a hole formed in the main body part 10. This hole supports the ear strap 20 in a state where the ear strap 20 is passed through the hole. In this case, it is preferable that a reinforcement member made of metal or resin is attached along the edge of the hole so that the ear strap 20 can displace smoothly while remaining within the hole. Likewise, the support part 34 may be hook-shaped or gate-shaped, or may be a hole formed in the main body part 10.

The foregoing embodiment described an example in which the mask 1 is provided with both the support parts 32 and the support parts 34. However, the mask 1 may be provided with only the support parts 32, or with only the support parts 34. If only the support parts 34 are provided, the support parts 34 correspond to the "first support part".

The foregoing embodiments described examples in which the ear straps 20 exhibit elasticity. However, the ear straps 20 need not exhibit elasticity. In this case, a nonwoven fabric, for example, can be used as the material of the ear straps 20.

The invention claimed is:

1. A mask comprising:

a main body part configured to cover a mouth of a wearer;

a pair of ear straps provided on left and right sides of the main body part, the pair of ear straps being configured to be hooked over ears of the wearer; and for each of the pair of ear straps, a first support part that is provided on the main body part, the first support part supporting a first location of an intermediate part of each of the pair of ear straps, wherein:

for each of the pair of ear straps, the main body part has an upper end fixing point where an upper end part of each of the pair of ear straps is fixed, and a lower end fixing point where a lower end part of each of the pair of ear straps is fixed, each first support part is located in a top region which is a region between each upper end fixing point and an upper end of the main body part with respect to a vertical direction of the main body part, or each first support part is located in a bottom region which is a region between each lower end fixing point and a lower end of the main body part with respect to the vertical direction, each first support part has a support shaft onto which each of the pair of ear straps is configured to be hooked when the mask is worn, and a top plate functioning as a stopper configured to ensure that each of the pair of ear straps does not come off the support shaft, and each top plate is apart from the main body part such that an interval between the top plate and the main body part is greater than a thickness of each of the pair of ear straps, wherein the first support parts do not immobilize the pair of ear straps.

2. The mask according to claim 1, wherein each first support part is located in the top region.

3. The mask according to claim 2, comprising:

for each of the pair of ear straps, a second support part that is positioned on the main body part, the second support part supporting a second location of the intermediate part of each of the pair of ear straps, wherein the second support part is located in the bottom region.

4. The mask according to claim 3, wherein each second support part is located in a vicinity of a respective side end of the main body part.

5. The mask according to claim 3, wherein each second support part supports the respective second location of each of the pair of ear straps on an outer surface side of the main body part.

6. The mask according to claim 3, wherein each second support part is located inside the respective lower end fixing point with respect to a horizontal direction of the main body part.

7. The mask according to claim 3, wherein each second support part is positioned in the same location as the respective lower end fixing point with respect to a horizontal direction of the main body part.

8. The mask according to claim 3, further comprising a plurality of the second support parts for each of the pair of ear straps, wherein the plurality of the second support parts are positioned in different locations with respect to a horizontal direction of the main body part.

9. The mask according to claim 2, wherein each first support part is located inside the respective upper end fixing point with respect to a horizontal direction of the main body part.

10. The mask according to claim 9, wherein for each of the pair of ear straps, an angle formed by a straight line passing through the upper end part and the first location of each of the pair of ear straps and a straight line passing through the upper end part and extending in the vertical direction is represented by $\alpha$, wherein $15° \leq \alpha \leq 45°$.

11. The mask according to claim 2, wherein each first support part is provided in the same location as the respective upper end fixing point with respect to a horizontal direction of the main body part.

12. The mask according to claim 2, further comprising:

a plurality of the first support parts for each of the pair of ear straps, wherein the plurality of the first support parts are positioned in different locations with respect to a horizontal direction of the main body part.

13. The mask according to claim 1, wherein each first support part is located in the bottom region.

14. The mask according to claim 13, wherein each first support part is located inside the respective lower end fixing point with respect to a horizontal direction of the main body part.

15. The mask according to claim 13, wherein each first support part is positioned in the same location as the respective lower end fixing point with respect to a horizontal direction of the main body part.

16. The mask according to claim 13, further comprising a plurality of the first support parts for each of the pair of ear straps, wherein the plurality of the first support parts are positioned in different locations with respect to a horizontal direction of the main body part.

17. The mask according to claim 1, wherein each first support part is located in a vicinity of a respective side end of the main body part.

18. The mask according to claim 1, wherein each first support part supports the respective first location of each of the pair of ear straps on an outer surface side of the main body part.

19. The mask according to claim 1, wherein the pair of ear straps are elastic.

20. The mask according to claim 1, wherein the main body part has a moisture-retaining material holding part that holds a moisture-retaining material.

* * * * *